US010004308B2

(12) United States Patent
Carpenter

(10) Patent No.: US 10,004,308 B2
(45) Date of Patent: Jun. 26, 2018

(54) COLLAR FOR PORTABLE DEVICE

(71) Applicant: Thomas Gerard Carpenter, Tucson, AZ (US)

(72) Inventor: Thomas Gerard Carpenter, Tucson, AZ (US)

( * ) Notice: Subject to any disclaimer, the term of this patent is extended or adjusted under 35 U.S.C. 154(b) by 0 days. days.

(21) Appl. No.: 14/544,493

(22) Filed: Jan. 13, 2015

(65) Prior Publication Data

US 2016/0198821 A1 Jul. 14, 2016

(51) Int. Cl.
*A45C 11/00* (2006.01)
*A45F 5/02* (2006.01)

(52) U.S. Cl.
CPC ..... *A45C 11/00* (2013.01); *A45F 5/02* (2013.01); *A45C 2011/002* (2013.01); *A45F 2200/0516* (2013.01)

(58) Field of Classification Search
CPC ..... A45C 11/00; A45C 2011/001–2011/003; A45F 2200/0508; A45F 2200/0525
USPC ..... 224/271, 929, 251, 919
See application file for complete search history.

(56) References Cited

U.S. PATENT DOCUMENTS 3,423,571 A * 1/1969 Trachtenberg ..... A47J 41/005 174/135
3,990,617 A * 11/1976 Carter ..... A45F 5/02 224/251
4,046,295 A * 9/1977 Eichler ..... A45F 5/02 224/242
4,299,344 A * 11/1981 Yamashita ..... H04B 1/3888 224/242
4,485,946 A * 12/1984 Liautaud ..... A45F 5/021 224/196
4,775,083 A * 10/1988 Burger ..... A45F 5/02 224/240
4,845,650 A * 7/1989 Meade ..... G07B 1/00 101/66
4,845,738 A * 7/1989 Takano ..... H04M 1/2155 379/424
4,858,798 A * 8/1989 Siddoway ..... A45F 5/02 224/240
5,038,400 A * 8/1991 Baracat ..... H04B 1/3877 455/347
5,114,060 A * 5/1992 Boyer ..... B62J 7/06 224/413
5,187,744 A * 2/1993 Richter ..... B60R 11/0241 224/553
5,205,447 A * 4/1993 Hambrick ..... B60R 11/0241 224/277
5,229,701 A * 7/1993 Leman ..... H02J 7/0045 320/115
5,282,246 A * 1/1994 Yang ..... B60R 11/0241 379/432
5,375,749 A * 12/1994 Oliva ..... A45F 5/02 224/242
5,410,762 A * 5/1995 Maskovich ..... A45F 5/00 2/312
5,450,993 A * 9/1995 Guerrero ..... A45F 5/02 206/305
5,528,770 A * 6/1996 Castilla ..... A45F 5/02 224/269
5,779,205 A * 7/1998 Ching ..... B60R 11/0241 248/205.8

(Continued)

*Primary Examiner* — Brian D Nash

(57) ABSTRACT

Briefly, embodiments of a collar, which may be suitable for removably securing a portable communications device to a user, are disclosed.

19 Claims, 4 Drawing Sheets

(56) References Cited

U.S. PATENT DOCUMENTS 5,836,496 A * 11/1998 Levin ..... B60R 11/0241 224/275
5,956,630 A * 9/1999 Mackey ..... H04B 1/086 2/60
5,996,956 A * 12/1999 Shawver ..... G06F 1/1626 248/309.1
6,000,592 A * 12/1999 Clanin ..... B62J 11/00 224/413
6,023,147 A * 2/2000 Cargin, Jr. ..... G06F 1/1626 235/375
6,062,518 A * 5/2000 Etue ..... B60R 11/0241 224/542
6,141,417 A * 10/2000 Lopez ..... A45F 5/021 379/446
6,154,997 A * 12/2000 Aluotto ..... F41C 33/02 224/239
6,176,403 B1 * 1/2001 Svare ..... A45F 5/00 206/315.1
6,290,112 B1 * 9/2001 Iver ..... A44B 11/266 224/197
6,341,218 B1 * 1/2002 Poplawsky ..... B60R 11/0241 379/420.01
6,427,959 B1 * 8/2002 Kalis ..... H04M 1/04 248/288.11
6,701,159 B1 * 3/2004 Powell ..... A45C 11/00 379/446
6,848,605 B2 * 2/2005 Dillenberger ..... A45F 5/02 224/242
6,926,182 B2 * 8/2005 Cragg ..... A45F 5/021 224/236
7,017,243 B2 * 3/2006 Carnevali ..... A45F 5/00 24/3.1
7,052,312 B2 * 5/2006 Liou ..... G06F 1/1626 439/529
D595,679 S * 7/2009 Devenish, III ..... D14/137
7,757,913 B2 * 7/2010 Fichera ..... A45F 5/02 224/197
7,889,860 B2 * 2/2011 Tinoco ..... B60R 11/02 379/446
8,079,452 B2 * 12/2011 Drew ..... A45C 3/02 190/109
8,215,596 B2 * 7/2012 Duan ..... F16M 11/10 16/337
8,479,960 B2 * 7/2013 Lopez-Apodaca . B60R 11/0241 224/312
8,622,447 B1 * 1/2014 Wirtz ..... H04B 1/385 224/217
RE45,179 E * 10/2014 Bodkin ..... A45F 5/021 190/119
D718,289 S * 11/2014 Brand ..... D14/250
9,027,814 B2 * 5/2015 Tages ..... A45F 5/021 224/666
9,064,386 B2 * 6/2015 Won ..... G10K 9/22
9,402,122 B2 * 7/2016 Richardson ..... G06F 1/1626
9,560,435 B2 * 1/2017 Richardson ..... G06F 1/1626
9,781,986 B2 * 10/2017 Merzon ..... A45C 11/00
2002/0009195 A1 * 1/2002 Schon ..... B60R 11/0241 379/454
2002/0100782 A1 * 8/2002 Marvin ..... B60R 11/0241 224/483
2003/0083115 A1 * 5/2003 Kato ..... H04B 1/3877 455/573
2004/0014506 A1 * 1/2004 Kemppinen ..... A45C 11/24 455/575.1
2005/0072822 A1 * 4/2005 Stotts ..... A45F 5/02 224/269
2008/0203127 A1 * 8/2008 Castillo-Garrison .. A45C 13/30 224/607
2010/0171021 A1 * 7/2010 Smith ..... A45C 13/30 248/558
2011/0000945 A1 * 1/2011 Mongan ..... A45F 5/02 224/581
2011/0031287 A1 * 2/2011 Le Gette ..... F16M 11/04 224/101
2011/0132950 A1 * 6/2011 Culver ..... B60R 11/0241 224/485
2011/0221316 A1 * 9/2011 Richmond ..... A45C 11/00 312/236
2011/0278885 A1 * 11/2011 Procter ..... B60R 11/0235 297/135
2012/0280014 A1 * 11/2012 Lopez-Apodaca . B60R 11/0241 224/539
2012/0325882 A1 * 12/2012 Tages ..... A45F 5/021 224/676
2013/0032617 A1 * 2/2013 Adelman ..... A45F 5/00 224/191
2013/0299533 A1 * 11/2013 Gronewoller ..... A45F 5/021 224/191
2014/0014725 A1 * 1/2014 Martin ..... G06K 7/0004 235/440
2014/0124557 A1 * 5/2014 Velarde ..... A61F 5/0123 224/576
2014/0134874 A1 * 5/2014 Palmer ..... F16M 11/14 439/527
2014/0305985 A1 * 10/2014 Chang ..... A45F 5/021 224/676
2015/0157116 A1 * 6/2015 Williams ..... A45F 5/004 224/162
2015/0173497 A1 * 6/2015 Yu ..... A45F 5/00 224/218
2015/0201740 A1 * 7/2015 Richardson ..... A45F 5/00 224/255
2015/0289616 A1 * 10/2015 Bransfield ..... A45F 5/02 224/250
2015/0305462 A1 * 10/2015 Rothbaum ..... B65D 63/10 224/575
2015/0305480 A1 * 10/2015 Brousseau ..... A45F 5/10 224/267
2015/0327657 A1 * 11/2015 Roberts ..... A45C 11/00 224/191
2016/0007723 A1 * 1/2016 Georges ..... A45F 5/00 224/580
2016/0021998 A1 * 1/2016 Fathollahi ..... A45C 11/00 224/191
2016/0039357 A1 * 2/2016 Jang ..... A45F 5/00 224/567
2016/0050774 A1 * 2/2016 Merenda ..... H05K 5/0086 224/162
2016/0058145 A1 * 3/2016 Whitten ..... A45C 11/00 224/191
2016/0066460 A1 * 3/2016 Rayner ..... A45C 13/008 224/191
2016/0183667 A1 * 6/2016 MacColl ..... A45F 5/00 224/222
2016/0198824 A1 * 7/2016 Rayner ..... G06F 1/1626 224/191
2017/0231373 A1 * 8/2017 Koren ..... A45F 5/00 224/191

* cited by examiner

COLLAR FOR PORTABLE DEVICE

BACKGROUND

1. Field

The present disclosure relates generally to equipment that may be used, for example, to secure a portable device to an article of clothing worn by a user, such as a belt, for example, so that the portable device may be immediately accessible to the user.

2. Information

Emergency services personnel may, at times, have a need for immediate access to a portable communications device. Thus, in many instances, emergency services personnel may wish to secure a portable communications device to a belt, or other article of clothing, such as protective clothing, for example, so that the emergency services personnel can immediately grasp and operate the communications device.

However, in general, equipment used to secure a portable communications device to an article of clothing must not impede device functionality. For example, if the portable communications device is equipped with a display, a device used to secure the communications device to an article of clothing must not obstruct viewing of the display. In another example, equipment used to secure portable communications device to an article of clothing must remain secured to the communications device during charging, for example, in a manner that permits emergency personnel workers to quickly take hold of the communications device and rapidly advance to an emergency services scene, for example. However, currently-available equipment, which may be used to secure a portable communications device to an article of protective clothing, may fall short of meeting operational expectations and needs.

BRIEF DESCRIPTION OF DRAWINGS

Claimed subject matter is particularly pointed out and/or distinctly claimed in the concluding portion of the specification. However, both as to organization and/or method of operation, together with objects, features, and/or advantages thereof, claimed subject matter may be understood by reference to the following detailed description if read with the accompanying drawings in which:

Figure 1:
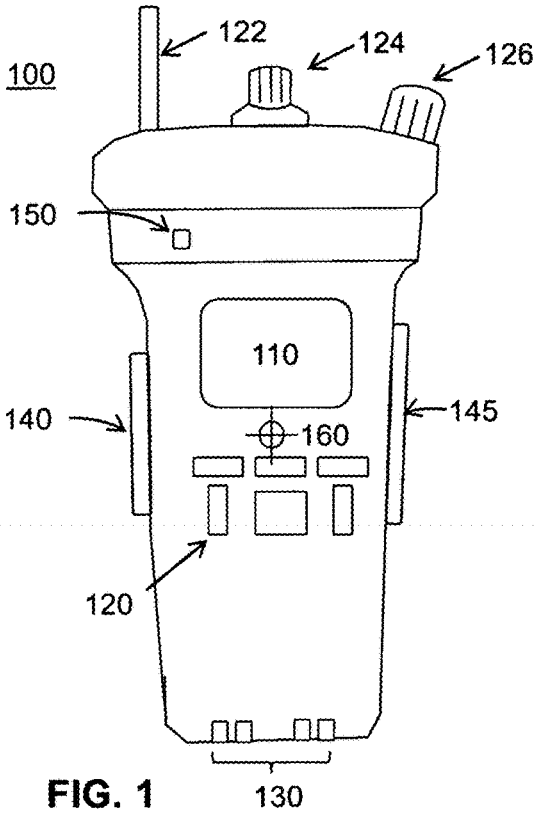
FIG. 1 is a front view of a portable communications device, which may accommodate a collar that accords with an embodiment.

Reference is made in the following detailed description to accompanying drawings, which form a part hereof, wherein like numerals may designate like parts throughout to indicate corresponding and/or analogous components. It will be appreciated that components illustrated in the figures have not necessarily been drawn to scale, such as for simplicity and/or clarity of illustration. For example, dimensions of some components may be exaggerated relative to other components. Further, it is to be understood that other embodiments may be utilized. Furthermore, structural and/or other changes may be made without departing from claimed subject matter. It should also be noted that directions and/or references, for example, up, down, top, bottom, and so on, may be used to facilitate discussion of drawings and/or are not intended to restrict application of claimed subject matter. Therefore, the following detailed description is not to be taken to limit claimed subject matter and/or equivalents.

DETAILED DESCRIPTION

In the following detailed description, numerous specific details are set forth to provide a thorough understanding of claimed subject matter. For purposes of explanation, specific numbers, systems, and/or configurations are set forth, for example. However, it should be apparent to one skilled in the relevant art having benefit of this disclosure that claimed subject matter may be practiced without specific details. In other instances, well-known features may be omitted and/or simplified so as not to obscure claimed subject matter. While certain features have been illustrated and/or described herein, many modifications, substitutions, changes, and/or equivalents may occur to those skilled in the art. It is, therefore, to be understood that appended claims are intended to cover any and all modifications and/or changes as fall within claimed subject matter.

Reference throughout this specification to "one implementation," "an implementation," "one embodiment," "an embodiment" and/or the like may mean that a particular feature, structure, or characteristic described in connection with a particular implementation or embodiment may be included in at least one implementation or embodiment of claimed subject matter. Thus, appearances of such phrases, for example, in various places throughout this specification are not necessarily intended to refer to the same implementation or to any one particular implementation described. Furthermore, it is to be understood that particular features, structures, or characteristics described may be combined in various ways in one or more implementations. In general, of course, these and other issues may vary with context. Therefore, particular context of description or usage may provide helpful guidance regarding inferences to be drawn.

In this context, the terms "coupled," "connected," and/or similar terms, may be used. It should be understood that these terms are not intended as synonyms. Rather, "connected" may be used to indicate that two or more elements or other components, for example, are in direct physical and/or electrical contact; while, "coupled" may mean that two or more components are in direct physical or electrical contact; however, "coupled" may also mean that two or more components are not in direct contact, but may nonetheless co-operate or interact. The term "coupled" may also be understood to mean indirectly connected, for example, in an appropriate context.

The terms, "and," "or," "and/or," and/or similar terms, as used herein, may include a variety of meanings that also are expected to depend at least in part upon the particular context in which such terms are used. Typically, "or" if used to associate a list, such as A, B, or C, is intended to mean A, B, and C, here used in the inclusive sense, as well as A, B, or C, here used in the exclusive sense. In addition, the term "one or more" and/or similar terms may be used to describe any feature, structure, and/or characteristic in the singular and/or may be used to describe a plurality or some other combination of features, structures and/or characteristics. In this context, the term "between" and/or similar terms are understood to include "among" if appropriate for the particular usage. Likewise, in this context, the terms "compatible with," "comply with" and/or similar terms are understood to include substantial compliance or substantial compatibility. Though it should be noted that these are merely illustrative examples and claimed subject matter is not limited to this example.

As previously mentioned, in many environments, such as environments involving emergency service personnel, for example, a portable device, such as a portable two-way radio may be removably secured to an article of clothing worn by an emergency services worker. For example, a portable two-way radio may be at least temporarily affixed to a user's belt, or other article of clothing, such as fire protection clothing, so that the emergency services worker may have immediate access to the two-way radio. In many instances, a premium may be placed on immediate accessibility of the device especially during circumstances in which the emergency services worker is wearing gloves, a helmet, and other protective equipment.

However, any device or apparatus used to secure a portable communications device, for example, to an article of clothing, should not impede or inhibit portable device functionality. Accordingly, in many instances, a device or apparatus used to secure portable communications device to an article of clothing must satisfy functional and operational constraints. In some instances, such as if an individual is wearing protective clothing, such as fire-protective gloves, for example, an apparatus used to secure portable communications device must provide ample clearance between device controls and the apparatus so that an emergency-services worker may operate the communications device even while wearing such protective clothing.

FIG. 1 is a front view of a portable communications device, which may accommodate a collar that accords with an embodiment 100. A portable communications device may comprise display 110, which may advise the user of the channel such as frequency, digital network identification, and so forth, on which the portable communications device may receive and transmit audio and/or data signals. The portable communications device may additionally comprise control switches 120, which may permit the user select display modes, or to make other adjustments in operation of the portable communications device. In embodiments, the portable communications device may include one or more microphones 150, which may permit a user to transmit audio signals, for example. In some implementations, two or more of microphones 150 may be provided, which may permit a noise canceling feature in which ambient and/or background noise may be minimized while near field voice signals may pass. Accordingly, a user may operate portable communications device 100 in a relatively noisy environment by depressing, for example, push-to-talk switch 145. In embodiments, a user may transmit voice signals using portable communications device 100 using a remote microphone, which may be coupled to the communications device by way of external connector 140. Portable communications device 100 may further include exposed conductors 130, which may permit the device to be placed on the charger when not in use.

The portable communications device of embodiment 100 may additionally include antenna 122, which may assist in transmitting and/or acquiring electromagnetic signals, for example, and may further include channel selector 124 and volume control knob 126. In particular embodiments, channel selector 124 and volume control knob 126 may be spaced from one another so as to accommodate control of the communications device by an individual, such as an emergency services worker, who may be wearing protective clothing, such as fire protective gloves and so forth.

Figure 2:
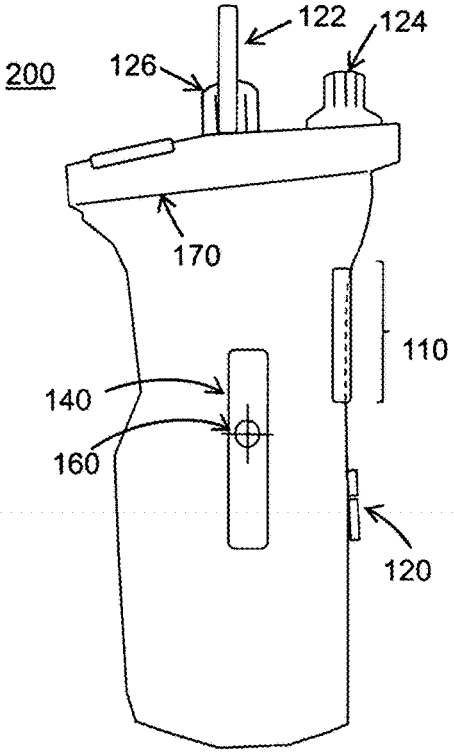
FIG. 2 is a side view of a portable communications device, which may accommodate a collar that accords with an embodiment.

FIG. 2 is a side view of a portable communications device, which may accommodate a collar that accords with an embodiment 200. In FIG. 2, connector 140, which may be utilized to accommodate a remote microphone, may be seen as well as downwardly sloping lip 170, which may permit emergency services worker, for example, to grasp the communications device, while using fire protective gloves, for example, while precluding the communications device from slipping through the user's hand. Display 110 as well as control switches 120 are shown as being the side, and antenna 122 is shown in front of volume control knob 126. As shown in FIGS. 1 and 2, center of gravity 160 may be seen near the approximate center of the device.

As shown in FIG. 2, at least a portion of the plane of display 110 may be recessed inward relative to, for example, microphone 150. In certain embodiments, such recession of display 110 may provide a level of shade, which may permit viewing of the display under high ambient light conditions, such as in direct sunlight, for example.

Figure 3:
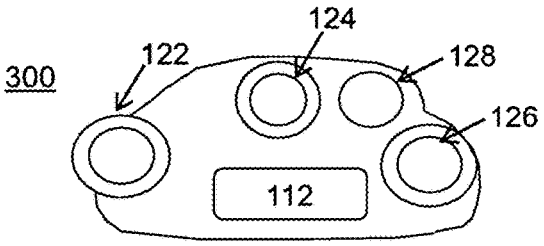
FIG. 3 is a top view of a portable communications device, which may accommodate a collar that accords with an embodiment.

FIG. 3 is a top view of a portable communications device, which may accommodate a collar that accords with an embodiment 300. FIG. 3 shows antenna 122, channel selector knob 124, volume control knob 126, along with distress signal control 125, which may be utilized to indicate that an emergency services worker is in immediate need of assistance. FIG. 3 also indicates display 112, which may provide an abridged set of channel and/or network parameters, at least some of which may also be displayed using display 110. In embodiments, display 112, which may be disposed upon an upward-facing horizontally flat surface, may permit an emergency services worker to briefly glance in a downward direction while the portable communications device is affixed to the worker's belt or other accoutrement.

Figure 4:
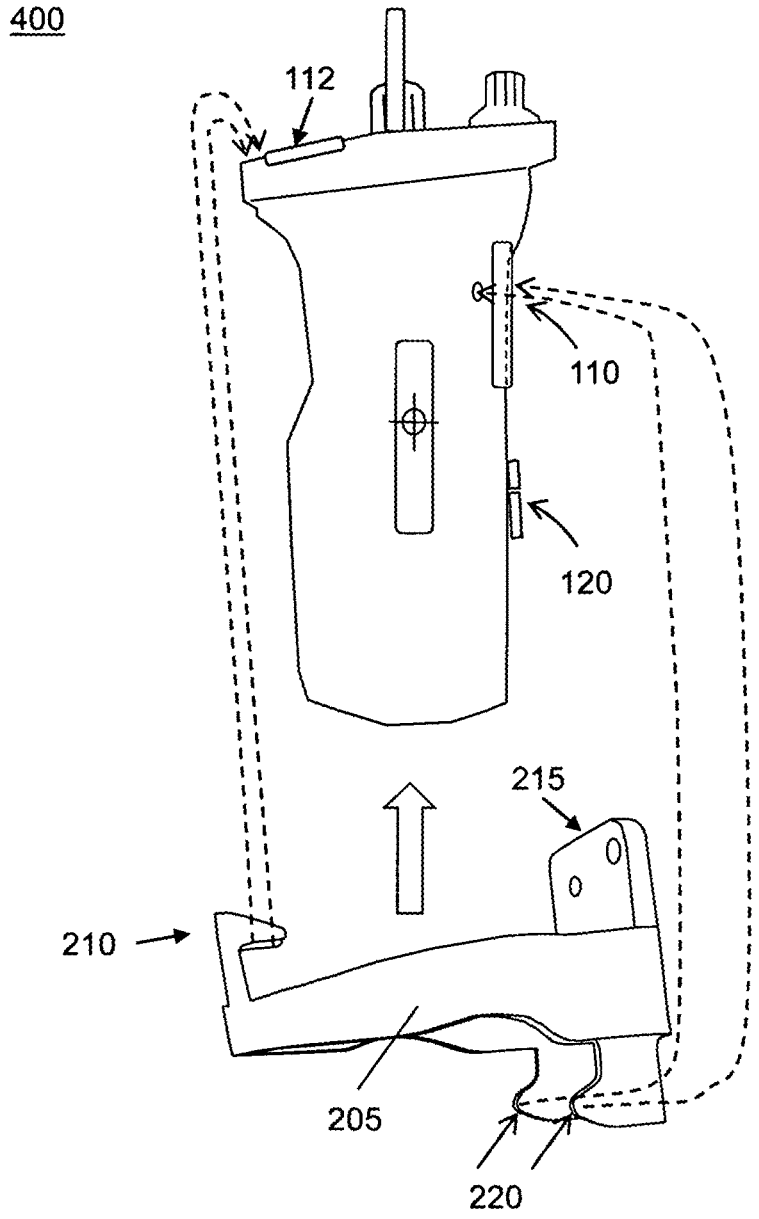
FIG. 4 is a side view of a portable communications device and a collar to be removably secured from the portable communication device in accordance with an embodiment.

FIG. 4 is a side view of a portable communications device and a collar to be removably secured from the portable communication device in accordance with an embodiment 400. In particular embodiments, collar 205 may be slid upward along the axis of a portable communications device to permit claw 210 to snap into place near the bottom of display 112 in a manner that does not significantly obscure the view of display 112. One or more teeth of claw 210 may be oriented at an approximately right angle (such as 90°), in a manner that permits a secure fit to a corner at which a substantially horizontal and vertical surface of the portable communications device meet. One or more of protruding features 220 of collar 205 may rest within a recessed portion of the portable communications device, such as to the sides of display 110, as is shown in greater detail in FIG. 7. In particular embodiments, vertical component 215 may comprise a substantially rigid and opaque material, which may include one or more holes as shown in FIG. 4. Although not shown explicitly in FIG. 4, vertical component 215 may continue along a downward direction, which may provide a base to which protruding features 220 may be coupled.

In certain embodiments, when removably secured to the portable communications device, vertical component 215 may thus operate as a shroud, which may shield or otherwise provide shade to at least some portion (e.g., perhaps as much as one half or a larger fraction of the display) of display 110 from direct sunlight, for example. Protruding features 220, which may comprise one or more prongs or fin-shaped features, may comprise a sufficient horizontal dimension so as to permit vertical component 215 to standoff from display 110, which may permit display 110 to be read by only slightly tilting the portable communications device in a counterclockwise direction, for example. In other embodiments, such as shown FIG. 7, vertical component 215 may extend in a downward direction beyond protruding features 220 to provide additional shading of display 110.

Figure 5:
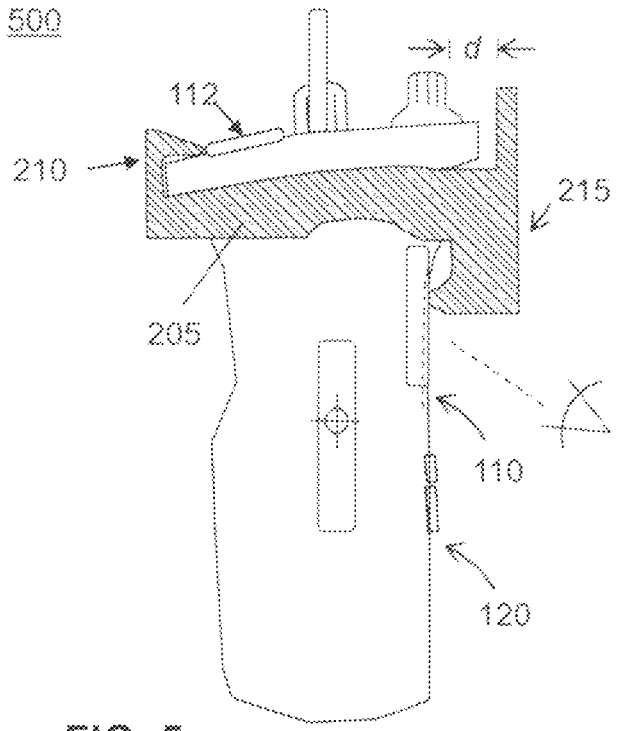
FIG. 5 is a side view of a collar removably secured to a portable communications device in accordance with an embodiment.

FIG. 5 is a side view of a collar removably secured to a portable communications device in accordance with an embodiment 500. As shown in FIG. 5, vertical component 215, when removed the secured to portable communications device, is separated from a volume control knob by a distance "d," which may permit operation of device controls by individual, for example, fire-protective gloves, for example. As is also shown in FIG. 5, claw 210 is shown as contacting the upper left corner of the portable communications device in a manner that does not obstruct the view of, for example, display 112. As is further shown in FIG. 5, collar 205 may be disposed well above control switches 120, thereby allowing operation of the controls while the collar is removably secured to a portable communications device.

Figure 6:
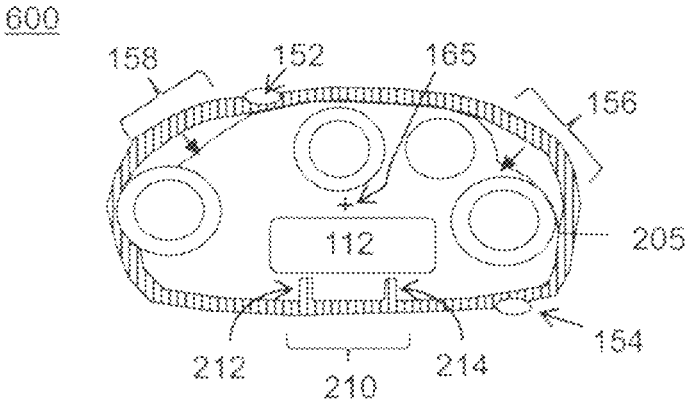
FIG. 6 is a top view of a collar removably secured to a portable communications device in accordance with an embodiment.

FIG. 6 is a top view of a collar removably secured to a portable communications device in accordance with an embodiment 600. As shown in FIG. 6, orifices 152 and 154 represent holes of approximately 1.0 cm, for example, which may permit unattenuated air coupling with a corresponding number of microphones of the portable communications device. Also shown at particular locations about collar 205, orifices 152 and 154 may be greater in number, such as three orifices, four orifices, and so forth, and may be disposed at other locations in addition to, or in lieu of the locations indicated in FIG. 6. Additionally, although orifices 152 and 154 are indicated as disposed at substantially opposite sides of collar 205, orifices 152 and 154 may be disposed at virtually any location of collar 205, and claimed subject matter is not limited in this respect.

As is also shown in FIG. 6, collar 205 may include portions 156 and 158, which may be bowed or flared in a slightly outward direction from center axis 165 of the portable communications device. In certain embodiments, such bowing or flaring collar of 205 may permit slight inward deformation the collar when the collar is removably secured to a portable communications device. In particular embodiments, such slight inward deformation of bowed or flared portions 156 and/or 158 may permit collar 205 to be firmly secured to a portable communications device.

As is further shown in FIG. 6, claw 210 may comprise two teeth, such as teeth 212 and 214. However, in other embodiments, claw 210 the comprise additional another number of teeth, such as one tooth, three teeth, four teeth, and so forth, and claimed subject matter is not limited in this regard.

Figure 7:
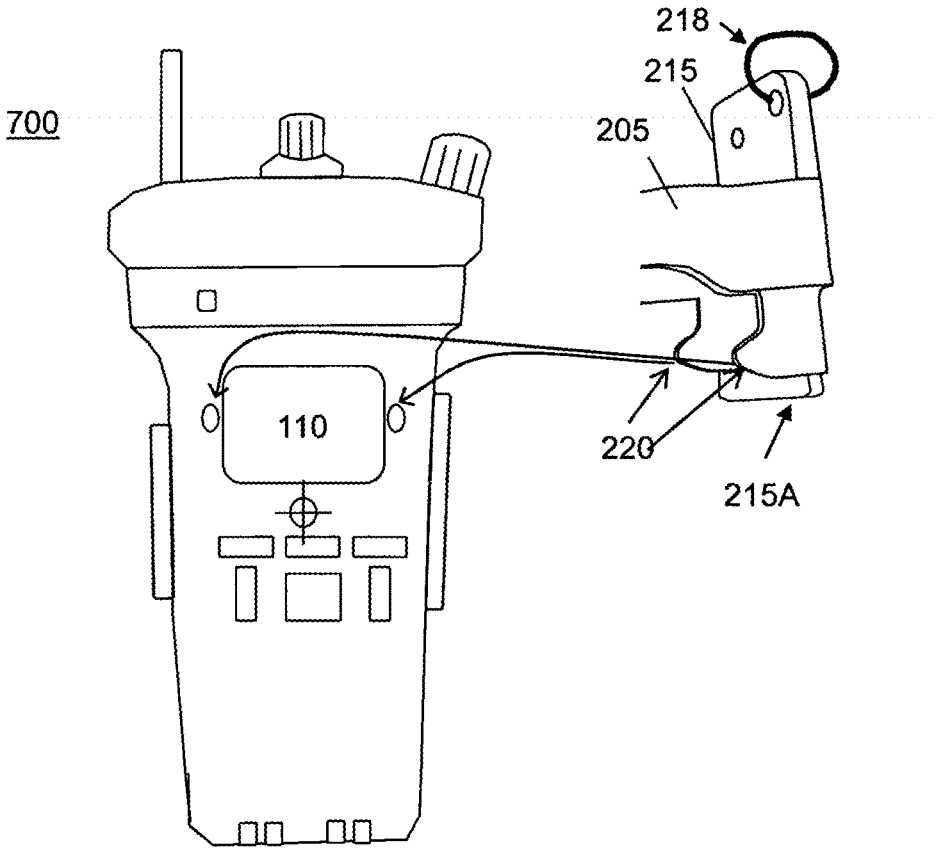
FIG. 7 is a front view of a portable communications device and a portion of a collar showing coupling points at which protruding features make contact with the portable communications device according to an embodiment.

FIG. 7 is a front view of a portable communications device and a portion of a collar showing coupling points at which protruding features make contact with the portable communications device according to an embodiment 700. As mentioned previously herein, display 110 may be slightly recessed from other surfaces of a portable communications device. Accordingly, when collar 205 is removably secured about a portable communications device, one or more of protruding features 220 may contact portable communications device to the sides of display 110. In at least one embodiment, vertical component 215 may comprise portion 215A, which may extend in a downward direction beyond the bases of protruding features 220, so as to provide additional shading of display 110. However, in particular embodiments, portion 215A may comprise an opaque material that extends only slightly beyond the bases of protruding features 220, so as to provide shade for display 110 without unnecessarily obscuring viewing of the display, for example. In FIG. 7, vertical component 215 may comprise an eyelet through which ring 218 may be inserted, which may permit removably securing collar 205 to an object or to an article of clothing (or other accoutrement).

In embodiments, collar 205, claw 210, protruding features 220, and vertical component 215 may be constructed plastic injection molded material. Collar 205 may also be constructed, for example, of glass impregnated nylon, for example or may comprise a thermoplastic polymer, such as a polycarbonate material. However, those skilled in the art may select different materials to satisfy particular requirements, such as weight, durability, resistance to fire and/or chemical corrosives, and so forth.

While there has been illustrated and/or described what are presently considered to be example features, it will be understood by those skilled in the relevant art that various other modifications may be made and/or equivalents may be substituted, without departing from claimed subject matter. Additionally, many modifications may be made to adapt a particular situation to the teachings of claimed subject matter without departing from one or more central concept(s) described herein. Therefore, it is intended that claimed subject matter not be limited to the particular examples disclosed, but that such claimed subject matter may also include all aspects falling within appended claims and/or equivalents thereof.

What is claimed is:

1. An apparatus, comprising:

a portable communications device comprising a display;

a collar to completely surround and to be removably secured to the portable communications device, the collar including a claw, at a first side of the collar, operable to make contact with an upward-facing substantially horizontal surface of the portable device;

at a second side of the collar, the second side of the collar being directly opposite the first side of the collar, a first protruding feature to make contact at a first side of a display portion of the portable device and a second protruding feature to make contact at a second side of the display portion of the portable device; and an eyelet, configured to fasten the collar to an accoutrement via an at least partially ring-shaped clip, the eyelet disposed at a corner portion of the second side of the collar and directly opposite to the claw, the eyelet being positioned adjacent to, and in view of, one or more controls of the portable communications device.

2. The apparatus of claim 1, wherein the each of the first protruding feature and the second protruding features are fin-shaped, the fin-shaped first protruding feature and the fin-shaped second protruding feature spaced apart from one another so as to make intimate contact at the first and second sides of the display portion of the portable device.

3. The apparatus of claim 2, wherein the fin-shaped first protruding feature and the fin-shaped second protruding feature are coupled to each another by a substantially rigid material.

4. The apparatus of claim 3, wherein the first protruding feature and the second protruding feature form two standoffs for a shroud.

5. The apparatus of claim 3, wherein the substantially rigid material is coupled to the collar and comprises a receptacle for accepting a fastener for coupling the collar to an object.

6. The apparatus of claim 3, wherein the substantially rigid material is at least partially opaque.

7. The apparatus of claim 1, wherein the collar comprises a polycarbonate material.

8. The apparatus of claim 1, wherein the collar comprises one or more outwardly flared portions to deform responsive to removably securing the collar to the portable device.

9. The apparatus of claim 1, wherein the one or more flared portions are to deform so as to provide and inward-directed force to secure the collar to the portable device.

10. The apparatus of claim 1, wherein the claw comprises two or more teeth.

11. The apparatus of claim 1, wherein the collar further comprises one or more orifices operable to provide air coupling with one or more microphones of the portable device.

12. The apparatus of claim 11, wherein the one or more orifices comprise two orifices disposed on approximately opposite sides of the collar.

13. An apparatus, comprising:

a portable communications device comprising a display, the display to indicate at least a frequency on which the portable communications device is to receive signals;

a collar to completely surround a portion of the portable communications device, the collar having a claw, proximate with a first end portion of the collar, for coupling to a substantially horizontal surface of the portable communications device, the collar coupled to exactly two fin-shaped features, proximate with a second end portion of the collar, the second end portion being opposite the first end portion of the collar, the claw and the exactly two fin-shaped features cooperating to removably secure the portable communications device to the collar, the exactly two fin-shaped features operable to make contact at first and second sides of the display; and an eyelet, configured to fasten the collar to an accoutrement via an at least partially ring-shaped clip, the eyelet disposed at a corner portion of the collar directly opposite the claw and in view of one or more controls of the portable communications device.

14. The apparatus of claim 13, the collar comprising at least one flared portion to deform responsive to insertion of the portable communications device into the collar.

15. The apparatus of claim 13, wherein the claw comprises two or more teeth.

16. The apparatus of claim 15, wherein the two or more teeth are disposed at a substantially 90 degree angle, so as to couple to a corner of the portable communications device.

17. The apparatus of claim 13, wherein the collar further comprises one or more orifices that operate to provide air coupling with one or more microphones of the portable communications device.

18. An apparatus, comprising:

a portable device having a display; and a collar to completely surround a portion of the portable device, comprising:

a claw, proximate with a first end portion of the collar, for coupling to a substantially horizontal surface of the portable device;

exactly two fin-shaped features, proximate with a second end portion of the collar, directly opposite the first end portion of the collar, for contacting opposite sides of the display of the portable device, wherein the claw and the exactly two fin-shaped features operate to removably secure the collar to the portable device; and an eyelet, disposed at a corner portion of the collar opposite the claw, the eyelet being in view of one or more controls of the portable device, the eyelet configured to fasten the collar to an accoutrement via an at least partially ring-shaped clip to removably secure the collar to an article of clothing.

19. The apparatus of claim 18, wherein the collar further comprises:

one or more flared portions which, upon removably securing to the portable device, deform so as to cooperatively maintain and inward force directed toward a center axis of the portable device.

* * * * *